United States Patent [19]

DiFazio

[11] 3,992,843

[45] Nov. 23, 1976

[54] GLAZING ADAPTOR

[75] Inventor: Joseph DiFazio, Troy, Mich.

[73] Assignee: Acorn Building Components, Inc., Detroit, Mich.

[22] Filed: Aug. 25, 1975

[21] Appl. No.: 607,142

[52] U.S. Cl. ..... 52/398; 52/616

[51] Int. Cl.[2] ..... E04B 1/62

[58] Field of Search ..... 52/398, 616, 203, 202

[56] References Cited

UNITED STATES PATENTS

| | | | |
|---|---|---|---|
| 3,442,059 | 5/1969 | Kessler | 52/616 X |
| 3,698,148 | 10/1972 | Marantier | 52/616 X |
| 3,875,706 | 4/1975 | Okawa | 52/616 X |
| 3,889,434 | 6/1975 | Shelver | 52/398 X |

*Primary Examiner*—Price C. Faw, Jr.

*Assistant Examiner*—Carl D. Friedman

*Attorney, Agent, or Firm*—Cullen, Settle, Sloman & Cantor

[57] ABSTRACT

A glazing adaptor for converting the effective width of the window panel receiving opening of a window frame from a first width to a second width, with the difference between the first and second widths exceeding the thickness of a pane of glass. The adaptor is a rigid unitary insulating structure including a first portion for frictional engagement with the window frame opening and a second portion to frictionally retain a window panel. Each of the adaptor portions includes flexible insulating barbs positioned for tight, water-resistant sealing with the window frame opening and the window panel, respectively. The second portion of the adaptor also includes resilient pads positioned to cushion the window panel.

4 Claims, 4 Drawing Figures

GLAZING ADAPTOR

BACKGROUND OF THE INVENTION

The invention herein relates to an improved adaptor for mounting an insulated glass panel within a frame such as the frame formed of extruded aluminum or the like. More specifically, the invention herein relates to an adaptor for converting the effective opening of a window frame component from a first width, such as the width of a double-glass insulated panel, to receive a panel of a different width such as a triple-insulated glass panel.

In the fabrication of thermally-insulated glazed window and door panels, it is conventional to form an extruded metal frame having two metal frame members thermally insulated from each other. A glass panel having two panes of glass thermally insulated from each other by a sealing spacer is inserted into the frame.

In the use of window panels and door panels of the type just described, a certain amount of heat loss through the double-thickness insulated glass is, of course, expected. It is known that heat loss may be significantly reduced by using a triple sealed insulated glass. That is, the use of three individual panes of glass with a sealing spacer between the first and second pane and another sealing spacer between the second and third pane.

For each window and door, each manufacturer designs aluminum extrusions of specific cross-sections with only the frame opening being standard to receive a double-pane insulated panel. Hence, to also provide extrusions with an opening to receive a triple pane insulated panel would require a double inventory for each manufacturer and distributor. Furthermore, each manufacturer would have to double the number of costly aluminum extrusion dies. Then, there is the cost of the extra aluminum for the larger opening frames. Thus, it was not economical to manufacture and stock frames with triple-panel openings as well as frames with double-panel openings prior to the present invention.

Hence, the invention herein relates to a standard or universal glazing adaptor to modify the effective frame opening from double-panel width to triple-panel width. Specifically, the invention relates to an adaptor having a first portion to be inserted in a window or door frame opening of a size to accommodate a sealed double-pane glazed panel, and a second portion which provides an opening of a size to receive a sealed triple-pane glazed panel. The adaptor is a unitary structure of a low cost insulating material and has sufficient flexibility to accommodate normal variations in sizes amoung triple-pane glazed window panels. The adapter also includes a plurality of cushioning pads to protect the triple-pane glazed panel from shock and breakage which can occur during opening and closing of sliding glass doors and windows.

SUMMARY OF INVENTION

The invention herein contemplates a universal glazing adaptor for converting a frame opening from a first width to receive a glazed panel of a second width with the difference between the first and second widths exceeding the thickness of a pane of glass. The adaptor, which is preferably formed of a substantially rigid insulating plastic, includes a first portion for frictional engagement with the frame opening and a second portion to frictionally receive and retain the glazed panel. The second portion of the adaptor is slightly flexible to accommodate glazed panels of slightly varying widths. Each of the adaptor portions includes flexible insulating barbs positioned for tight water-resistant sealing of the adaptor to the frame and to the glazed panel, respectively. The second portion of the adaptor also includes resilient pads positioned to cushion the glazed panel from shock.

The various objects and advantages of the present invention will become apparent upon reading the following detailed description taken in conjunction with the drawings.

BRIEF DESCRIPTION OF DRAWINGS

In the drawings, where like reference numerals identify corresponding components.

DETAILED DESCRIPTION OF THE INVENTION

Figure 1:
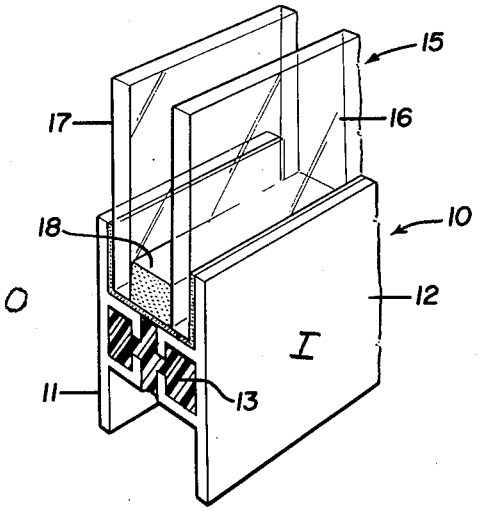
FIG. 1 is a perspective illustration of a thermally-insulated window frame and a double-thickness thermally-insulated glass panel inserted therein.

FIG. 1 illustrates a perspective view of a window or door frame 10 including a pair of opposed, spaced apart aluminum extrusions 11,12 which are maintained in rigid spaced apart relationship by an insulating material 13 such as a polyurethene.

Inserted in the window frame 10 is a double-glass or double-pane window panel 15 comprising two panes of glass 16,17 maintained in a spaced apart relationship by an insulated sealing strip 18. Constructions such as those shown in FIG. 1 are old.

Figure 2:
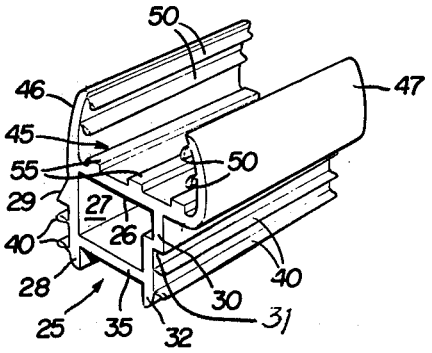
FIG. 2 is a perspective view of the glazing adaptor of the present invention for permitting the utilization of a triple-pane thermally-insulated glass panel in the same double-width frame extrusion of FIG. 1.

In order to increase the thermal-insulating quality of the window between the inside I, and the outside O, it has been known to utilize a triple-glass panel 20, as illustrated in FIG. 2. A triple-glass panel includes three parallel panes of glass 21, with the first and second pane maintained in a spaced apart thermally insulated relationship by a sealing strip 22 and the second and third pane maintained in a spaced apart thermally-insulated relationship by a sealing strip 23. Triple-glass panels are also well known and serve to increase the thermal-insulating capabilities of the window between the outside, O, and inside, I, of the window.

Hence, the present invention contemplates the use of a universal adaptor 25 to modify the effective opening between the frame members 11 and 12 of the window frame 10 to receive a triple-glass panel 20.

The adaptor 25 is a unitary structure of a substantially rigid insulating material such as vinyl. The adaptor 25 includes a base 26 and a first portion 27 depending downwardly therefrom. The first portion 27 includes a first downwardly depending leg 28 having an external shoulder 29 and a second downwardly depending leg 30 spaced apart from leg 28. Leg 30 is recessed to provide an inwardly extending shoulder as at 31 and then continues in a downwardly extending leg portion 32. A cross support 35 joins leg 28 to the portion 32 of the leg 30. The shoulders 29 and 31 limit the depth of insertion of the adaptor into the frame 10.

Figure 3:
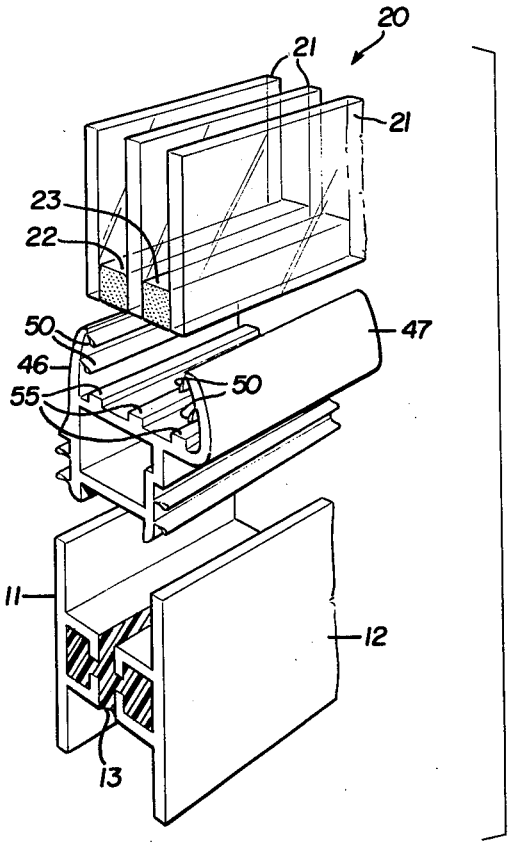
FIG. 3 is an exploded perspective view of a window frame, as used with a glazing adaptor to receive a triple glazed panel.
Figure 4:
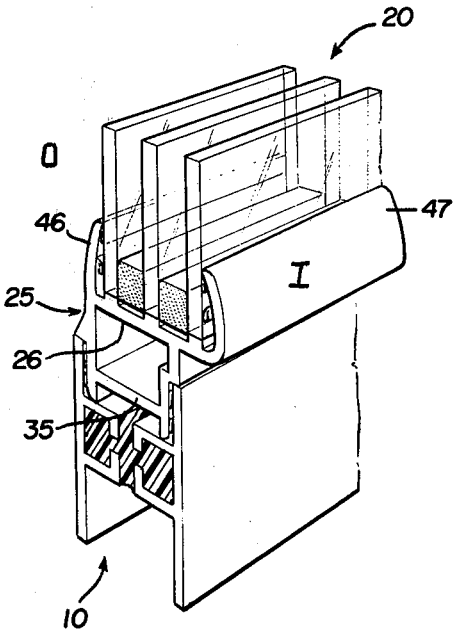
FIG. 4 is a perspective view of an assembled frame glazing adaptor and triple glazed panel unit.

As illustrated in greater detail in FIGS. 2, 3 and 4, the first portion 27 of the adaptor 25 includes four upwardly angled elongated barbs or seals 40 of a flexible vinyl material. These seals are provided externally of the legs 28 and 30 to provide a tight water-resistant fit between the first portion 27 of the adaptor 25 and the opening in the window frame 10.

The adaptor 25 also includes a second portion 45 including first and second spaced apart legs 46,47 extending upwardly from the base 26 with leg 46 being a continuation of leg 28 and with leg 47 being spaced outwardly beyond leg 30. Legs 46 and 47 taper gradually toward each other as they extend away from the base 26. Four downwardly angled vinyl seals or barbs 50 in the form of elongated strips of flexible vinyl are positioned interiorly of the second portion 45 of the adaptor with two such seals on the interior wall of each leg 46,47. These seals provide a tight water-resistant fit between the adaptor 25 and the triple-glass panel 20.

The slight inward taper of the legs 46,47 provides sufficient flexibility in the second portion 45 of the adaptor 25 to accommodate triple-glass panels of slightly varying widths.

At the top of the base 26, as illustrated in FIGS. 2, 3 and 4, i.e., at the second portion of the adaptor, there are three parallel elongated resilient vinyl pads 55. These pads are positioned so that upon insertion of the triple-glass panel 20, each pane of glass 21 rests on a vinyl pad 55. This provides a cushioning for each of the panes of glass during transit and during movement of the glass panel if it is in a sliding patio door or window, etc. These pads provide a cushion and absorb shock imparted to the glass panel, thereby substantilly eliminating breakage of the glass.

The adaptor 25 is manufactured by a double-extrusion process. A first vinyl is fed through an extruder and emerges in the configuration of the adaptor 25 except for the seals 40,50 and pads 55. The adaptor so formed of rigid vinyl is then passed through a second extruder at which time a different vinyl plastic, i.e., a flexible vinyl plastic, is extruded onto the adaptor to provide the various seals and pads.

Thus, it may be seen that the adaptor of the present invention modifies an effective opening of a window frame to accommodate a glass panel of a substantially different size. The plastic is a natural insulator and is less costly than aluminum. Furhtermore, the cost of the extrusion dies are much less for plastic than for aluminum. Finally, since the opening between frame members 11 and 12 is standard for double-pane glazed panels, a single configuration of adaptor 25 may be used to convert substantially all cross-sectional configurations of frames 10 to receive triple-pane glazed panels.

It must be appreciated that various modifications may be made without departing from the spirit and scope of the present invention. Thus, while the present invention has been shown in the context of an adaptor for converting an opening for a double-glass panel into an opening for a triple-glass panel, adaptors may be utilized to convert the effective opening of an extrusion to accommodate virtually any number of parallel glass panels. In fact, a non-insulated single pane metal extrusion frame may be modified by the use of an adaptor of the present invention to receive double-panel insulated glass.

Similarly, by reversing the relative sizes of the first portion 27 and the second portion 45 of the adaptor so that the first portion 27 is wider than the second portion, the adaptor of the present invention may be utilized to reduce the effective opening of a window frame extrusion, such as where it has been decided that while the frame is thermally insulated, only a single-glass panel is desired. This may be accomplished by merely reducing the effective width of the second portion 45 of the adaptor 25 relative to the first portion 27.

Hence, the present invention should not be construed in a restrictive sense, but should be limited only by the spirit and scope of the following claims.

What is claimed is:

1. A glazing adaptor for modifying the effective width of a frame opening from a first thickness to a second thickness with the difference between said first and second thickness exceeding the thickness of a pane of glass, comprising:

a generally flat thin rigid base of insulating material;

a frame-engaging portion formed integrally with said base, said frame-engaging portion being formed of relatively rigid insulating material and having first and second spaced apart parallel legs extending downwardly from one side of said base;

each of said legs of said frame-engaging portion having an outwardly extending shoulder to limit the extent of insertion of said frame-engaging portion into a frame opening; and a receptacle portion to receive a glass panel subassembly, said receptacle portion formed of an insulating material and formed integrally with said flat base, said receptacle portion including first and second substantially rigid spaced apart legs extending upwardly from the side of said base opposed from said frame-engaging portion, said first and second legs of said receptacle portion tapering slightly toward each other in a direction away from said base and being more flexible than the legs of said frame-engaging portion to accommodate the insertion of a glass panel subassembly;

whereby upon insertion of the frame-engaging portion into a frame opening, the receptacle portion provides an effective glass panel opening of substantially different thickness from the frame opening.

2. The invention as defined in claim 1 wherein, said first and second legs of said frame-engaging portion each include sealing strips more flexible and more resilient than the legs of said frame-engaging portion and positioned externally thereof and formed integrally therewith to provide a water-tight seal between said legs and a frame when said adaptor is inserted in said frame.

3. The invention as defined in claim 1 wherein, each of said legs of said receptacle portion include sealing strips more flexible and more resilient than the legs of said receptacle portion and projecting inwardly thereof and formed integrally therewith to provide a tight water-resistant seal between said receptacle portion and a glass panel.

4. The invention as defined in claim 1 and further including discrete vinyl cushion means more flexible and more resilient than said base and attached to said flat base and extending into said receptacle portion of said adaptor, each cushion means to provide a shock-absorbing surface to contact the glass of a glass panel subassembly inserted into said receptacle portion.

* * * * *